US006196883B1

(12) United States Patent
Bechaz et al.

(10) Patent No.: US 6,196,883 B1
(45) Date of Patent: Mar. 6, 2001

(54) CONNECTION SPRING FOR ELECTRICAL CONNECTIONS

(75) Inventors: Bernard Bechaz, Villeurbanne; Stéphane Prost, Arnas; Philippe France, Chazelles sur Lyon, all of (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/459,894

(22) Filed: Dec. 14, 1999

(30) Foreign Application Priority Data

Dec. 23, 1998 (FR) ..... 98 16585

(51) Int. Cl.[7] ..... H01R 4/40
(52) U.S. Cl. ..... 439/789; 439/828; 439/835
(58) Field of Search ..... 439/816, 789, 439/826, 835, 834, 828

(56) References Cited

U.S. PATENT DOCUMENTS

| | | | | |
|---|---|---|---|---|
| 3,526,870 | * | 9/1970 | Mayala | 439/397 |
| 3,961,835 | * | 6/1976 | Huang et al. | 439/828 |
| 5,679,021 | * | 10/1997 | Kramer | 439/835 |
| 5,879,204 | * | 3/1999 | Delarue et al. | 439/835 |
| 5,993,244 | * | 11/1999 | Bechaz et al. | 439/789 |
| 6,004,168 | * | 12/1999 | Fuchs et al. | 439/835 |

FOREIGN PATENT DOCUMENTS

| | | |
|---|---|---|
| 1 266 194 | 4/1968 | (DE) . |
| 37 27 091 C1 | 2/1989 | (DE) . |
| 42 37 733 C1 | 12/1993 | (DE) . |
| 196 41 206 A1 | 3/1998 | (DE) . |
| 196 46 103 C1 | 3/1998 | (DE) . |
| 0 218 133 A2 | 4/1987 | (EP) . |
| 0735629 A1 | 10/1996 | (EP) . |

OTHER PUBLICATIONS

English Abstract of DE–1964103, Nov. 8, 1996.*

* cited by examiner

*Primary Examiner*—Khiem Nguyen
*Assistant Examiner*—Hae Moon Hyeon
(74) *Attorney, Agent, or Firm*—Oliff & Berridge, PLC

(57) ABSTRACT

This spring allows an electrical connection to a stripped wire to be made in a terminal strip. It has bearing branch intended to bear against a conducting fixed part and a rear branch, facing the bearing branch, linked via a springy linking region to the latter and the free end of which is curved toward the bearing branch in order to form a moveable pinching branch having, on the same side as its free end, an appreciably plane part provided with an opening intended for passage of the conducting fixed part and of the stripped wire in such a way that the edge of the opening lying on the same side as the free end of the moveable pinching branch keeps the stripped end of the wire pressed against the conducting fixed part. A linking region springingly links the two branches.

On the opposite side from the rear branch, the bearing branch is provided with a guiding region which extends parallel to the pinching branch.

19 Claims, 2 Drawing Sheets

CONNECTION SPRING FOR ELECTRICAL CONNECTIONS

BACKGROUND OF THE INVENTION

The present invention relates to a connection spring allowing an electrical connection to a stripped wire to be made in a terminal strip for electrical conductors.

DESCRIPTION OF THE PRIOR ART

It is known to use springs for keeping the end of a stripped conductor held against a current supply rail in a terminal strip. Documents DE 3,727,091 and DE 4,237,733 describe terminal strips of this type. Found in these documents is a pinching spring made of a flat springy material formed in a kind of loop. The pinching spring has a stop branch, intended to bear on a current rail, and a pinching branch bent back from the back part of the pinching spring, extending transversely to the current supply rail, as well as a springy bow which links together, at the rear, the back part and the stop branch. The pinching branch is provided with a pinching cavity. The current supply rail passes through this cavity. The spring is such that, when the stripped end of an electrical conductor is inserted into the pinching cavity, the spring presses the stripped end of this wire against the current supply rail.

When making a connection, the pinching branch is moved in order to allow insertion of the wire to be connected. A screwdriver generally causes this movement by it acting on the springy bow. With such connection devices, problems may arise when connecting the stripped end of a conductor. If the spring is not bottomed, it may happen that, when inserting the end of the conductor, the latter pushes the pinching branch of the spring and bends it. On releasing the spring, the latter presses the badly connected conductor against a wall of the casing and the operator believes that he has made a good connection. However, the electrical contact is bad and the terminal strip may become scorched or burnt. This problem happens especially with large conductors.

The terminal strip having the connection spring is generally placed in an insulating casing. Sometimes provided in this casing is a support for taking the free end of the pinching branch when the spring is tensioned. However, when for one reason or another the spring is deformed, it may happen that the free end of the pinching branch, instead of bearing on the support made in the casing, ends up underneath this support. As a result, the connection spring undergoes even greater deformation and/or this spring is jammed in the casing.

To solve these problems, it is known to guide the pinching branch. In the aforementioned documents of the prior art, this guiding function is provided by part of the current supply rail, this part also being called a strap. The latter is then bent twice: once to form a lateral face, the upper edge of which serves to guide the pinching branch of the spring, and a second time to form the bearing branch for the stripped wire, or vice versa. A figure in document DE-19,641,206 clearly shows such bending.

In this solution, only the upper edge of the strap serves to guide the spring. Only the upper edge of the entire lateral part of the strap is useful. A great deal of material is then used solely to produce a guiding edge. This increases the cost of the strap.

Another drawback with this solution is that the pinching branch is guided only on one side. The first problem mentioned above (the conductor bending the pinching branch as it is being inserted) is then only partially solved.

This is because, if a large conductor bears on the opposite side from the guiding edge of the strap, the pinching branch may all the same be deformed.

Another drawback with this solution is that it is solely adapted to the case in which the strap lies beneath the connection spring, that is to say on the same side as the springy region linking the bearing branch to the pinching branch. This solution is not at all suitable for mounting a strap above the spring, as shown in document EP-0,735,629.

The object of the present invention is to provide a novel connection device ensuring that, when the spring is stressed and relaxed, the pinching branch is guided and supported better. Advantageously, this device will have a lower manufacturing cost than the known spring devices and can be adapted to the case in which the linking strap is placed above the compression spring, as shown in document EP-0,735,629.

SUMMARY OF THE INVENTION

For this purpose, the present invention provides a connection spring allowing an electrical connection to a stripped wire to be made in a terminal strip for electrical conductors, which is made from a flat springy material and has a bearing branch intended to bear against a conducting fixed part of the terminal strip and a rear branch, facing the bearing branch, linked via a springy linking region to the latter and the free end of which is bent back toward the bearing branch in order to form a moveable pinching branch having, on the same side as its free end, an appreciably plane part provided with an opening intended for passage of the conducting fixed part and of the stripped wire in such a way that the edge of the opening lying on the same side as the free end of the moveable pinching branch keeps the stripped end of the wire pressed against the conducting fixed part, a linking region springingly linking the two branches.

According to the invention, the bearing branch, on the opposite side from the rear branch, is provided with a guiding region which extends parallel to the pinching branch.

Thus, guiding is achieved at the connection spring. This position makes it possible to minimize the amount of material needed for providing the guiding function. The additional material used to produce the guiding zone on the connection spring can easily be less than the amount of material generally used for the guiding on the conducting fixed part. The guiding region may also easily extend over the entire width of the spring. This makes it possible to ensure that the pinching branch is reliably supported.

In one embodiment of the connection spring, the guiding region extends so as to be approximately perpendicular to the bearing branch.

Advantageously, the guiding region is attached to the bearing branch at some distance from the free edge of the bearing branch that bears against the conducting fixed part.

In order to allow the pinching branch to be guided and supported symmetrically, the guiding region advantageously includes a window through which the conducting fixed part and the stripped wire to be connected pass.

In a preferred embodiment of the spring according to the invention, the guiding region is obtained by cutting at the bearing branch and then by bending. In this case, the cut produced in the bearing branch advantageously has the shape of a U, the base of the U lying on the same side as the free end of the bearing branch.

The invention also relates to a terminal strip for electrical conductors, which includes a connection spring as described above. Such a terminal strip may be fitted into any type of electrical apparatus requiring a wire to be connected. This may, for example, be a switch, a circuit breaker, etc. Such a terminal strip is particularly suitable for a terminal block. It is then placed in an insulating casing. Preferably, this insulating casing has a support on which a free end of the guiding region of the connection spring bears.

In any event, the invention will be more clearly understood with the aid of the following description which presents, by way of nonlimiting example, one embodiment of a connection spring according to the invention.

DESCRIPTION OF THE PREFERRED EMBODIMENT

Figure 1:
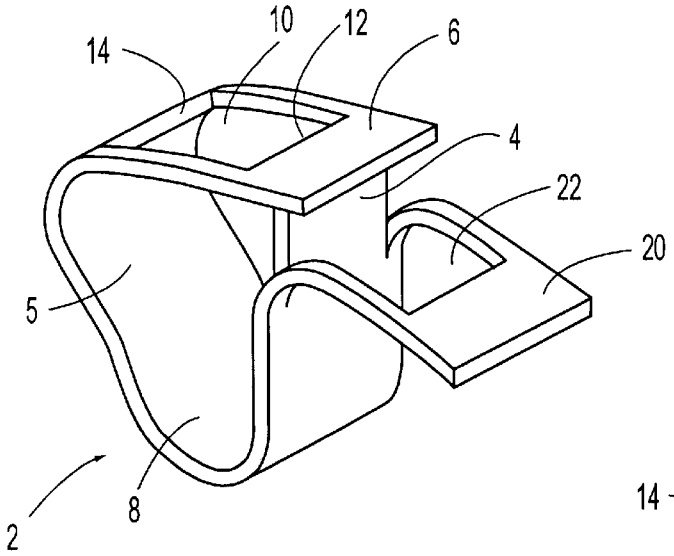
FIGS. 1 to 3 are views of a spring according to the invention, respectively in perspective, in a front view and in a top view.
Figure 2:
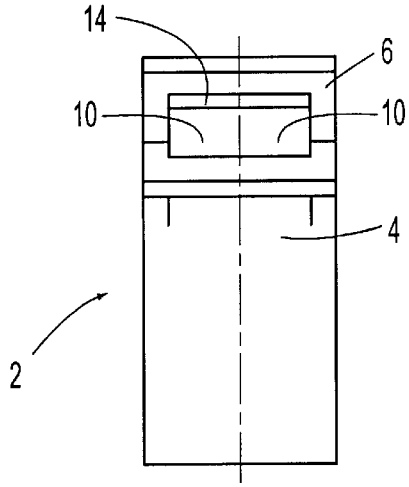
Figure 3:
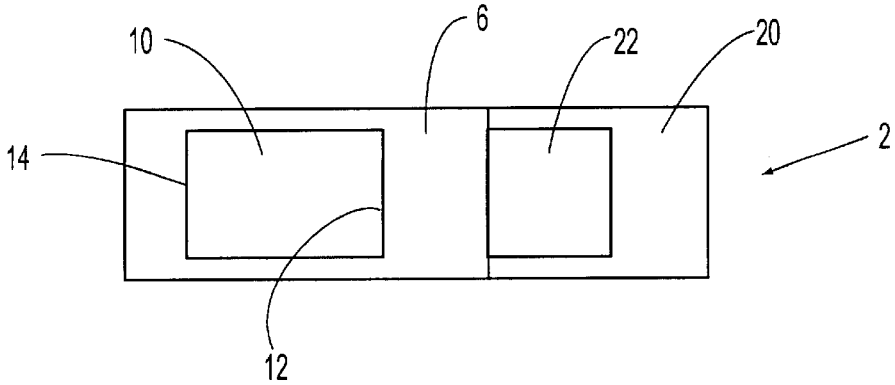

FIGS. 1 to 3 show a connection spring 2 according to the invention. This spring 2 is in the form of a loop having a fixed bearing branch 4 and a rear branch 5 which faces the bearing branch 4. A linking region 8 links the two branches 4 and 5, forming a loop. The free end of the rear branch 5 is bent back toward the bearing branch 4. The bent-back part forms a moveable pinching branch 6 which extends so as to be approximately perpendicular to the bearing branch 4. The spring is made from a strip of flat material, for example a strip of sheet steel.

The pinching branch 6 has a pinching opening or window 10 of approximately rectangular shape. This opening 10 has a pinching edge 12 on the same side as the free end of the pinching branch and a stop edge 14 on the same side as the linking region 8. As may be seen in FIGS. 4 and 5, this opening 10 is intended to take the free end of the bearing branch 4, a linking strap 16 and the stripped end of a wire 18.

The connection spring according to the invention also has a guiding region 20. The latter extends from the bearing branch 4 so as to be approximately parallel to the pinching branch 6 and just beneath this branch 6. The guiding region 20 extends away from the bearing branch 4, toward the outside of the spring 2, that is to say on the opposite side from the linking region 8 and from the rear branch 5. This guiding region 20 is oriented toward the outside of the loop.

The guiding region has approximately the shape of a U. The free ends of the branches of the U are attached to the bearing branch 4, thus defining an opening or window 22. The latter is intended to take the strap 16 and the end of a stripped wire 18 (FIG. 5).

The guiding region 20 is obtained by making a cut in the flat material from which the spring 2 is made, and then by bending it. The cut has the shape of a U and is made in the bearing branch 4, the base of the U being oriented toward the free end of the strip of flat material and the branches of the U being approximately parallel to the edges of this strip of material. The end of the strip of material is then bent back toward the outside of the loop so as to form the guiding region, as may be seen in the drawing. The ends of the branches of the guiding region 20 are sharply bent.

Figure 4:
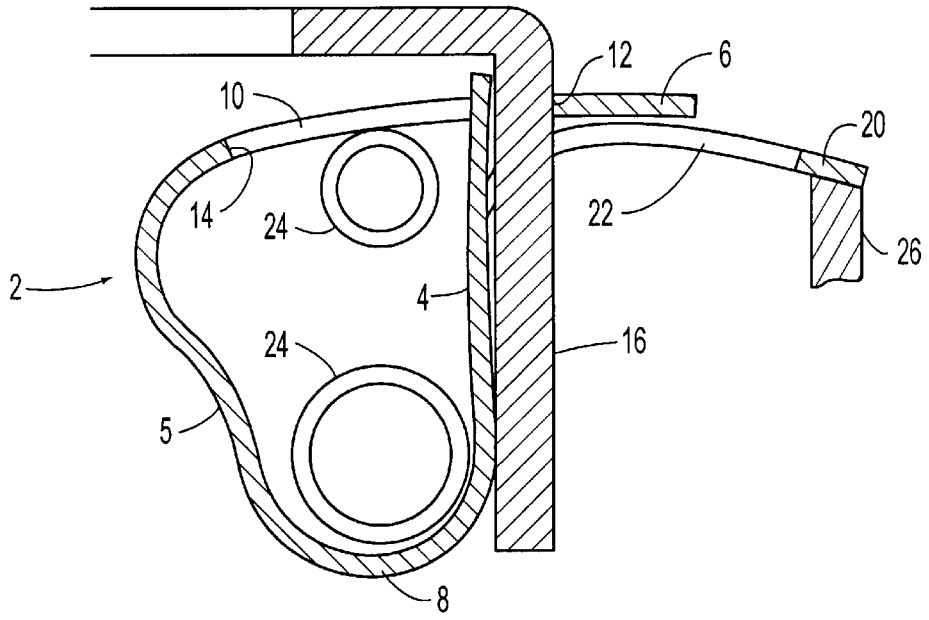
FIG. 4 is a longitudinal sectional view of the spring in FIGS. 1 to 3 in position mounted against a strap.
Figure 5:
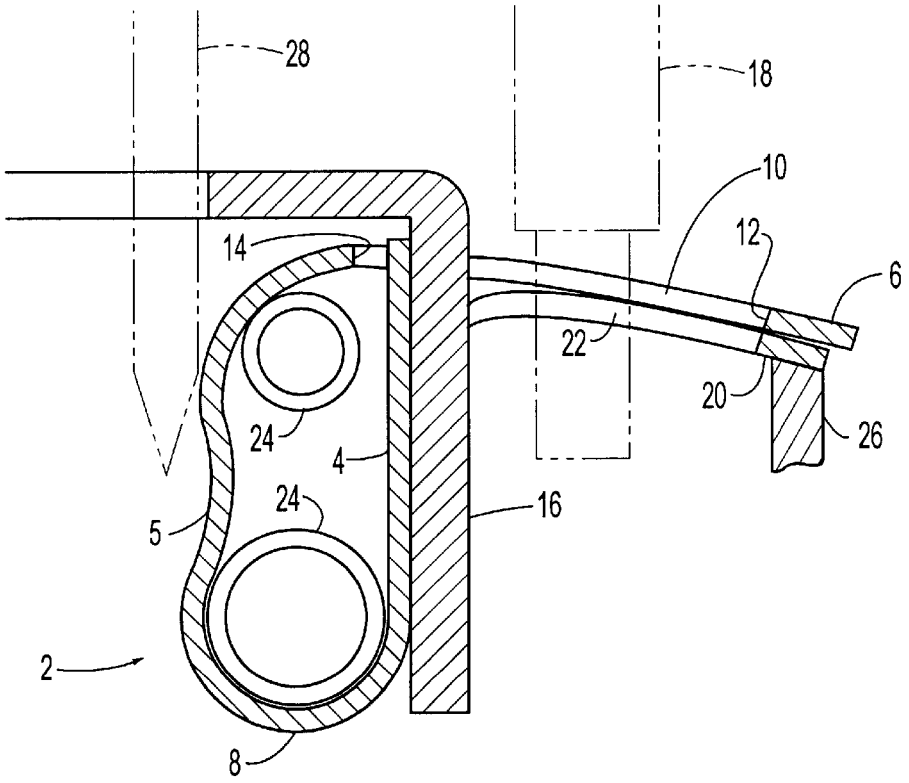
FIG. 5 is a view corresponding to FIG. 4, the connection spring being in a prestressed position.

FIGS. 4 and 5 show the spring described above in position in a terminal strip. The latter includes an insulating casing made of synthetic material obtained by molding. A housing is provided in this casing for housing, in a known manner, the connection spring 2. Projections 24 are provided in order to guarantee that the connection spring is correctly positioned and properly held in its housing. A support 26 is also provided in the insulating casing and is placed in such a way that the free end of the guiding region 20 bears on this support 26.

The linking strap 16 in this case has a very simple shape. In fact, level with the bearing branch 4, it has the shape of a plane blade. The bearing branch 4 bears on one face of this blade, which passes through the openings 10 and 22. In the relaxed position shown in FIG. 4, the pinching edge butts against the strap 16.

In order to make a connection, the spring 2 is stressed. To do this, for example, the end of a screwdriver 28 is used, this screwdriver pushing the pinching branch 6 in such a way that the opening 10 in the pinching branch 6 comes opposite the opening 22 in the guiding region 20. The linking region 8 then tends to bring the connection spring 2 back into its position shown in FIG. 4. The two openings facing each other, the end of a stripped wire 18 is inserted. By withdrawing the end of the screwdriver 28, the pinching branch 6 ends up, in a known manner, pinching the end of the stripped wire against the strap 16.

Throughout the movement of the pinching branch 6, both when the spring 2 is stressed and when the spring is relaxed in order to pinch the end of the stripped wire against the strap 16, the pinching branch 6 is guided on the guiding region 20. It is therefore unnecessary to provide guiding at the strap 16 or the insulating housing. In addition, the guiding provided by the guiding region 20 is provided over the entire width of the pinching branch 6. There is therefore symmetrical guiding with respect to the axis of this branch 6. The travel of the pinching branch 6 is thus well controlled.

Furthermore, the fact of providing the guiding region on the spring itself allows a saving of material to be made, and therefore allows a terminal strip with a connection spring to be produced at a lower cost. This is because very little material is needed to produce the guiding region 20, if comparison is made with the amount of material needed to provide guiding of the pinching branch at the conducting strap. The guiding region 20 is also easy to produce. This is because all that is required to produce it is cutting and bending.

Should the screwdriver blade 28 not operate the pinching branch 6 sufficiently, the end of the stripped wire 18 ends up bearing on the end of the pinching branch outside the window 10 provided for its passage. The presence of the guiding region therefore prevents the pinching part 6 from bending under the force exerted by the end of the stripped wire. When the operator removes the screwdriver blade 28, the wire is not held in the terminal strip. Gently pulling on the wire allows it to be removed from the casing. Compared with the spring terminal strips of this type in the prior art, the risk of deforming the pinching branch and of jamming the end of the stripped wire between the deformed pinching branch and a wall of the insulating casing is eliminated. The support 26, on which the guiding region 20 ends up resting, allows the deformation resistance of the pinching branch 6 to be appreciably increased. However, its presence is optional since the guiding region 20 can withstand the forces which are generally employed when a stripped end of a cable is being inserted, even when this is pushed strongly.

Since the guiding region 20 ensures that the pinching branch is guided perfectly, any risk of the pinching branch jamming during the operation of the latter is virtually eliminated.

As goes without saying, the invention is not limited to the embodiment described above by way of nonlimiting example; on the contrary, it encompasses all the variants thereof that lie within the scope of the claims hereinbelow.

What is claimed is:

1. A connection spring, allowing an electrical connection to a stripped wire to be made in a terminal strip for electrical conductors, comprising: a bearing branch intended to bear against a conducting fixed part of the terminal strip and a rear branch, facing the bearing branch, linked via a springy linking region to the latter and a free end of which is bent back toward the bearing branch in order to form a moveable pinching branch having, on the same side as the free end, an appreciably plane part provided with an opening intended for passage of the conducting fixed part and of the stripped wire in such a way that the edge of the opening lying on the same side as the free end of the moveable pinching branch keeps the stripped end of the wire pressed against the conducting fixed part, wherein the bearing branch is provided with a guiding region which extends approximately parallel to the pinching branch, the guiding region being disposed on the opposite side of the bearing branch from the rear branch.

2. The connection spring as claimed in claim 1, wherein the guiding region extends so as to be approximately perpendicular to the bearing branch.

3. The connection spring as claimed in claim 1, wherein the guiding region is attached to the bearing branch at some distance from the free edge of the bearing branch that ends up bearing against the conducting fixed part.

4. The connection spring as claimed in claim 1, wherein the guiding region includes a window through which the conducting fixed part and the stripped wire to be connected pass.

5. The connection spring as claimed in claim 1, wherein the guiding region is obtained by cutting in the bearing branch and then by bending.

6. The connection spring as claimed in claim 5, wherein the cut made in the bearing branch has the shape of a U, the base of the U lying on the same side as the free end of the bearing branch.

7. A terminal strip for electrical conductors, which comprises a connection spring as claimed in claim 1.

8. A terminal block comprising an insulating casing and at least one terminal strip as claimed in claim 7, wherein the insulating casing has a support on which a free end of the guiding region bears.

9. The connection spring as claimed in claim 2, wherein the guiding region is attached to the bearing branch at some distance from the free edge of the bearing branch that ends up bearing against the conduction fixed part.

10. The connection spring as claimed in claim 2, wherein the guiding region includes a window through which the conducting fixed part and the stripped wire to be connected pass.

11. The connection spring as claimed in claim 3, wherein the guiding region includes a window through which the conducting fixed part and the stripped wire to be connected pass.

12. The connection spring as claimed in claim 2, wherein the guiding region is obtained by cutting in the bearing branch and then by bending.

13. The connection spring as claimed in claim 3, wherein the guiding region is obtained by cutting in the bearing branch and then by bending.

14. The connection spring as claimed in claim 4, wherein the guiding region is obtained by cutting in the bearing branch and then by bending.

15. A terminal strip for electrical conductors, which comprises a connection spring as claimed in claim 2.

16. A terminal strip for electrical conductors, which comprises a connection spring as claimed in claim 3.

17. A terminal strip for electrical conductors, which comprises a connection spring as claimed in claim 4.

18. A terminal strip for electrical conductors, which comprises a connection spring as claimed in claim 5.

19. A terminal strip for electrical conductors, which comprises a connection spring as claimed in claim 6.

* * * * *